US009254010B2

(12) United States Patent
Hedrick

(10) Patent No.: US 9,254,010 B2
(45) Date of Patent: Feb. 9, 2016

(54) POCKETED ATHLETIC GARMENT

(71) Applicant: Tabitha Star Hedrick, Fredericksburg, VA (US)

(72) Inventor: Tabitha Star Hedrick, Fredericksburg, VA (US)

( * ) Notice: Subject to any disclaimer, the term of this patent is extended or adjusted under 35 U.S.C. 154(b) by 301 days.

(21) Appl. No.: 13/896,532

(22) Filed: May 17, 2013

(65) Prior Publication Data

US 2013/0305433 A1 Nov. 21, 2013

Related U.S. Application Data

(60) Provisional application No. 61/648,339, filed on May 17, 2012.

(51) Int. Cl.

| | |
|---|---|
| ***A41D 1/22*** | (2006.01) |
| ***A41D 27/20*** | (2006.01) |
| ***A41D 13/00*** | (2006.01) |
| *A41D 1/06* | (2006.01) |
| *A41D 1/14* | (2006.01) |

(52) U.S. Cl.

CPC ..... *A41D 1/22* (2013.01); *A41D 13/0017* (2013.01); *A41D 27/20* (2013.01); *A41D 1/06* (2013.01); *A41D 1/14* (2013.01); *A41D 2600/10* (2013.01)

(58) Field of Classification Search

CPC ..... A41D 2600/10; A41D 1/14; A41D 1/06; A41D 27/20–27/22

USPC ..... 2/220, 228, 238, 247–264

See application file for complete search history.

(56) References Cited

U.S. PATENT DOCUMENTS

| | | | | | |
|---|---|---|---|---|---|
| 1,920,061 | A * | 7/1933 | Carr | 224/676 |
| 2,359,012 | A * | 9/1944 | Sophier | 2/247 |
| 2,446,326 | A * | 8/1948 | Guithues | 2/238 |
| 2,601,036 | A * | 6/1952 | Liebowitz | 450/109 |
| 3,812,541 | A * | 5/1974 | Stuart | 2/237 |
| 4,079,871 | A * | 3/1978 | Sica | 224/677 |
| 4,193,136 | A * | 3/1980 | Pierce | 2/237 |
| 5,093,935 | A * | 3/1992 | Countee, Jr. | 2/400 |
| 5,124,190 | A * | 6/1992 | Isoe et al. | 428/173 |
| 5,161,257 | A * | 11/1992 | Arensdorf et al. | 2/465 |
| 5,172,430 | A * | 12/1992 | Lerma-Solis | 2/400 |
| 5,274,854 | A * | 1/1994 | Wenner et al. | 2/403 |
| 5,421,032 | A * | 6/1995 | Murphy | 2/67 |
| 5,870,777 | A * | 2/1999 | Hans | 2/238 |
| 6,006,363 | A * | 12/1999 | Karlin | 2/228 |
| 6,076,195 | A * | 6/2000 | Klein | 2/400 |
| 6,148,443 | A * | 11/2000 | Maastricht | A41D 1/08 2/227 |
| 6,182,297 | B1 * | 2/2001 | Duren et al. | 2/228 |
| 6,308,340 | B1 * | 10/2001 | Cook | 2/400 |
| 6,772,446 | B1 * | 8/2004 | Black | 2/406 |
| 6,789,270 | B1 * | 9/2004 | Pedrick | 2/228 |
| 7,000,261 | B1 * | 2/2006 | Loffredo | 2/400 |
| 8,458,819 | B1 * | 6/2013 | Hoole | 2/403 |
| 2003/0130070 | A1 * | 7/2003 | Nolan | 473/437 |
| 2004/0083538 | A1 * | 5/2004 | Thomas | 2/400 |
| 2005/0066424 | A1 * | 3/2005 | Salazar | 2/227 |
| 2005/0177920 | A1 * | 8/2005 | Wilkinson | 2/69 |
| 2006/0253963 | A1 * | 11/2006 | Limbaugh | 2/247 |
| 2007/0101481 | A1 * | 5/2007 | Stokesbary | 2/211 |
| 2009/0106874 | A1 * | 4/2009 | Shlush | 2/78.1 |
| 2009/0300818 | A1 * | 12/2009 | Waite et al. | 2/76 |
| 2009/0300826 | A1 * | 12/2009 | Harimoto | 2/403 |

(Continued)

*Primary Examiner* — Khaled Annis

(74) *Attorney, Agent, or Firm* — Maier & Maier, PLLC

(57) ABSTRACT

A pocketed athletic garment. The garment includes an outer layer, an inner layer, and a waistband coupled to the outer layer and the inner layer, the waistband including a plurality of pockets.

7 Claims, 6 Drawing Sheets

(56) References Cited

U.S. PATENT DOCUMENTS

2010/0180361 A1* 7/2010 Marois et al. ..... 2/252
2010/0275350 A1* 11/2010 Wong ..... 2/466
2010/0281595 A1* 11/2010 Gernes ..... 2/69
2010/0313336 A1* 12/2010 Carlson ..... 2/215
2011/0145980 A1* 6/2011 D'Alessandro ..... 2/254
2012/0311758 A1* 12/2012 Nicholson et al. ..... 2/67
2013/0091619 A1* 4/2013 Hacker et al. ..... 2/228

* cited by examiner

POCKETED ATHLETIC GARMENT

CROSS-REFERENCE TO RELATED APPLICATIONS

This application claims priority to U.S. Provisional Application 61/648,339, filed May 17, 2012 and entitled POCKETED ATHLETIC GARMENT, the entire contents of which are hereby incorporated by reference.

BACKGROUND

Known athletic garments can present several issues to the wearer. First, central seams of such garments can adjust during physical activity, resulting in discomfort for the wearer. Furthermore, to allow for increased freedom of movement, the length of such garments may be too short for the wearer's comfort. Finally, such athletic garments typically do not provide for comfortable carrying of the wearer's items, such as keys, mobile devices, and so forth. Pockets typically provided in such garments are substantially loose, resulting in the items contained therein bouncing during physical activity, and falling out from the pockets in some cases. Therefore, an athletic garment that can be worn comfortably, that can provide a desired aesthetic appearance, and that can hold personal items securely when desired.

SUMMARY

According to at least one exemplary embodiment, a pocketed athletic garment may be disclosed. The garment can include an outer layer, an inner layer, and a waistband coupled to the outer layer and the inner layer, the waistband including a plurality of pockets.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Figure 1:
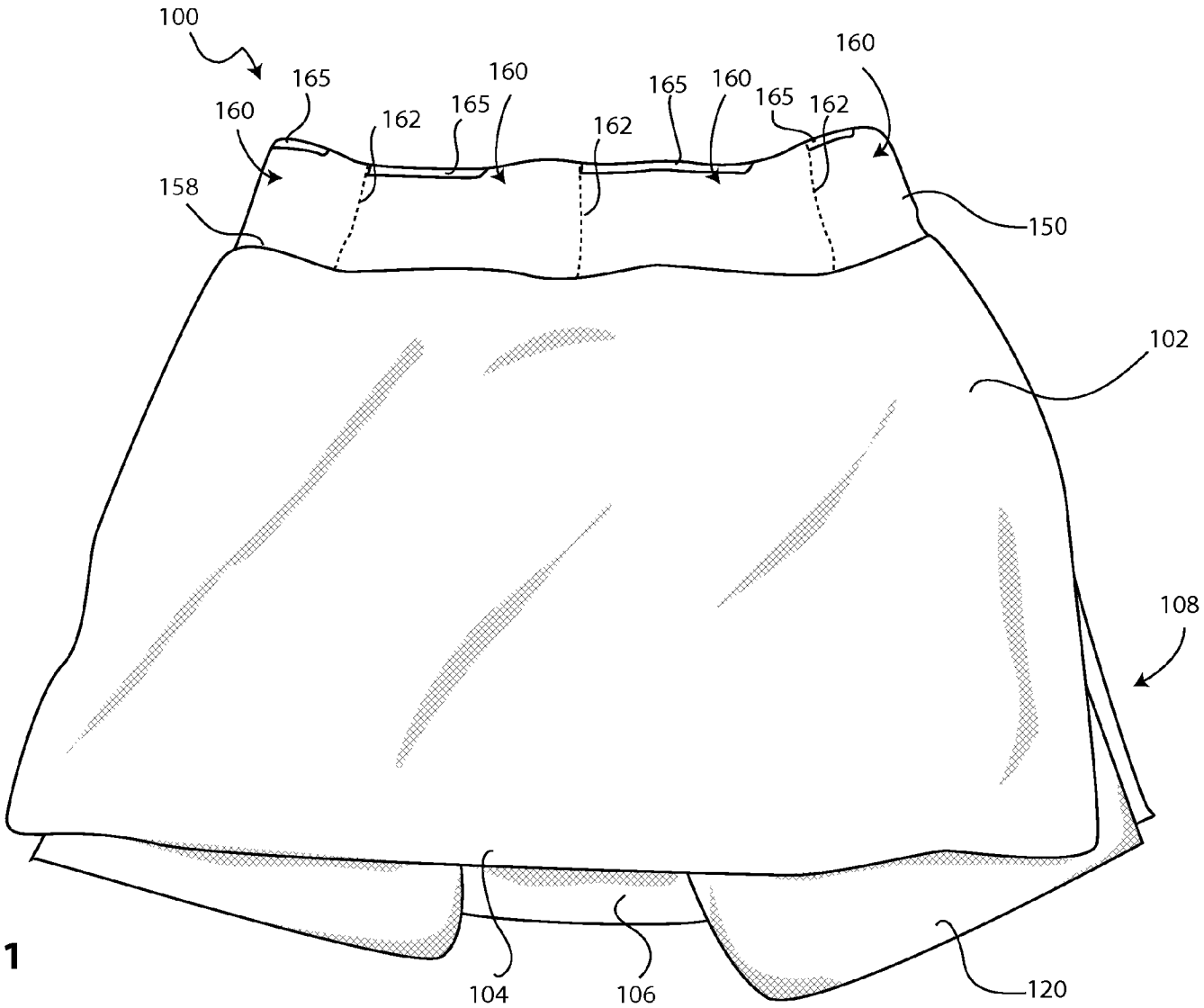
FIG. 1 is a view of an exemplary pocketed athletic garment, showing an outer layer.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

According to at least one exemplary embodiment, a pocketed athletic garment 100 may be disclosed. Garment 100 may include an outer layer 102, an inner layer 120, and a waistband 150.

Referring generally to FIGS. 1-4, outer layer 102 may be made from any desired material, for example, any type of fabric or textile that provides a desired appearance to outer layer 102. For example, the material of outer layer 102 may be a spandex blend. Furthermore, outer layer 102 may be in any desired garment style; for example, outer layer 102 may be provided as a skirt. In some exemplary embodiments, outer layer 102 may be formed from a plurality of portions, for example a front portion 104 and a rear portion 106. Front and rear portions 104, 106 may be joined substantially at the side edges thereof by any coupling method known in the art, for example by stitched seams. Additionally, outer layer 102 may include any desired functional or aesthetic features; for example, in an embodiment where outer layer 102 is a skirt, splits 108 may be provided between the side edges of front and rear portions 104, 106. Splits 108 may extend upward from the bottom edge of outer layer 102, for any desired length.

Inner layer 120 may have the form of a compression short, or any other form-fitting article of clothing known in the art. To that end, inner layer 120 may be made from any desired material that enables inner layer 120 to form a snug fit against the thighs, pelvic area, and waist of a wearer. For example, the material of inner layer 120 may be spandex, lycra, or any other similar elastic material, or a blend of desired materials.

Figure 2A:
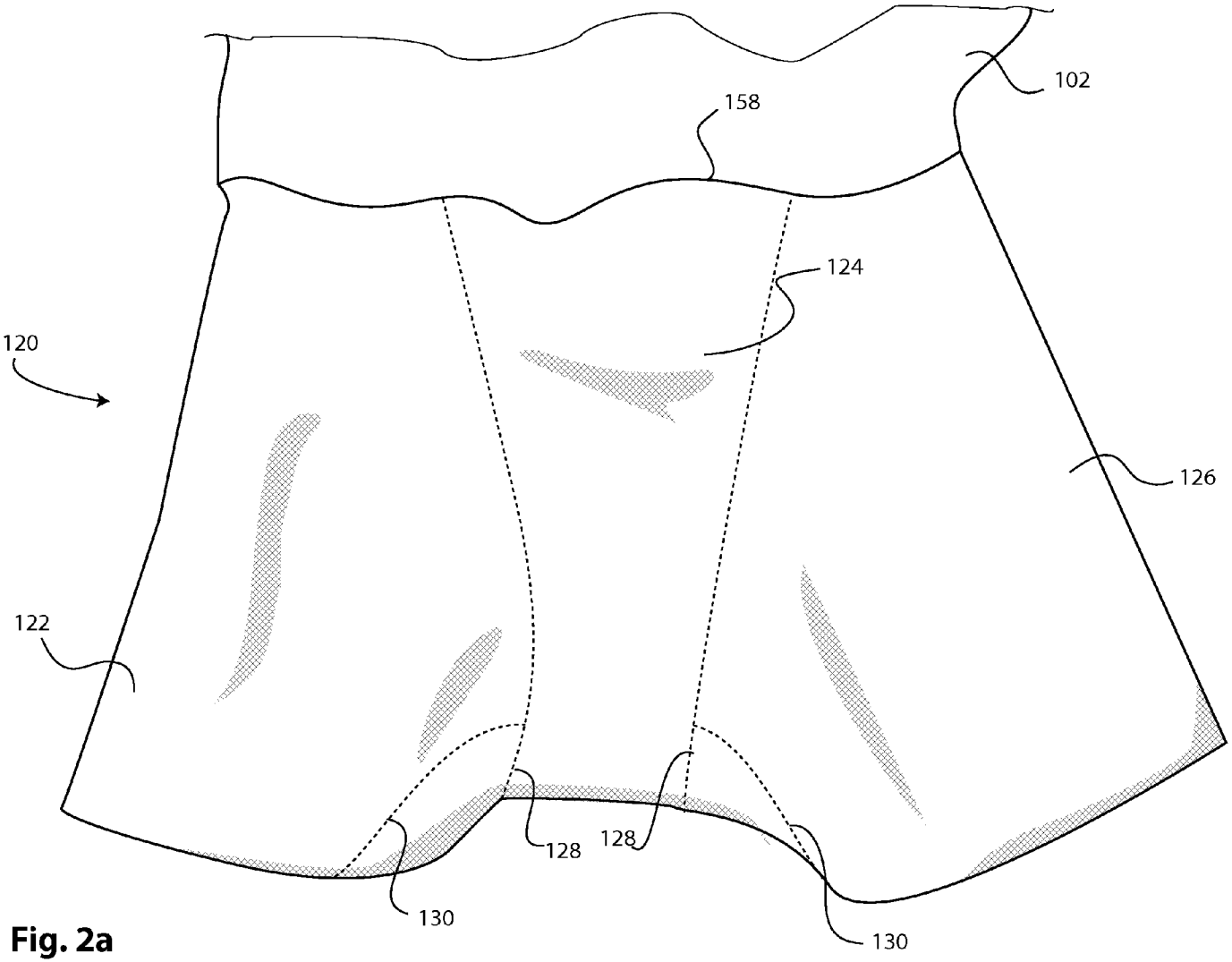
FIG. 2*a* is a view of an exemplary pocketed athletic garment, showing a first embodiment of an inner layer.

In some exemplary embodiments, as shown in FIG. 2*a*, inner layer 120 may be formed from a plurality of portions, for example, a first side portion 122, a central portion 124, and a second side portion 126. Central portion 124 may extend downwards from the top edge of inner layer 120, towards the crotch area, and then upwards to the top edge of inner layer 120, so as to form the front, bottom, and rear surfaces of inner layer 120. Central portion 124 may be joined to first and second side portions 122, 126 by a pair of seams 128, the seams being positioned such that, when garment 100 is worn, the seams extend along the sides of the wearer's crotch area, thus reducing the likelihood of inner layer 120 being wedged into uncomfortable positions while the wearer is exercising. Each of first and second portions 122, 126 may further include an inseam 130, for joining the edges of the particular portion so as to form a tubular enclosing for a portion of the corresponding leg of the wearer.

Figure 2B:
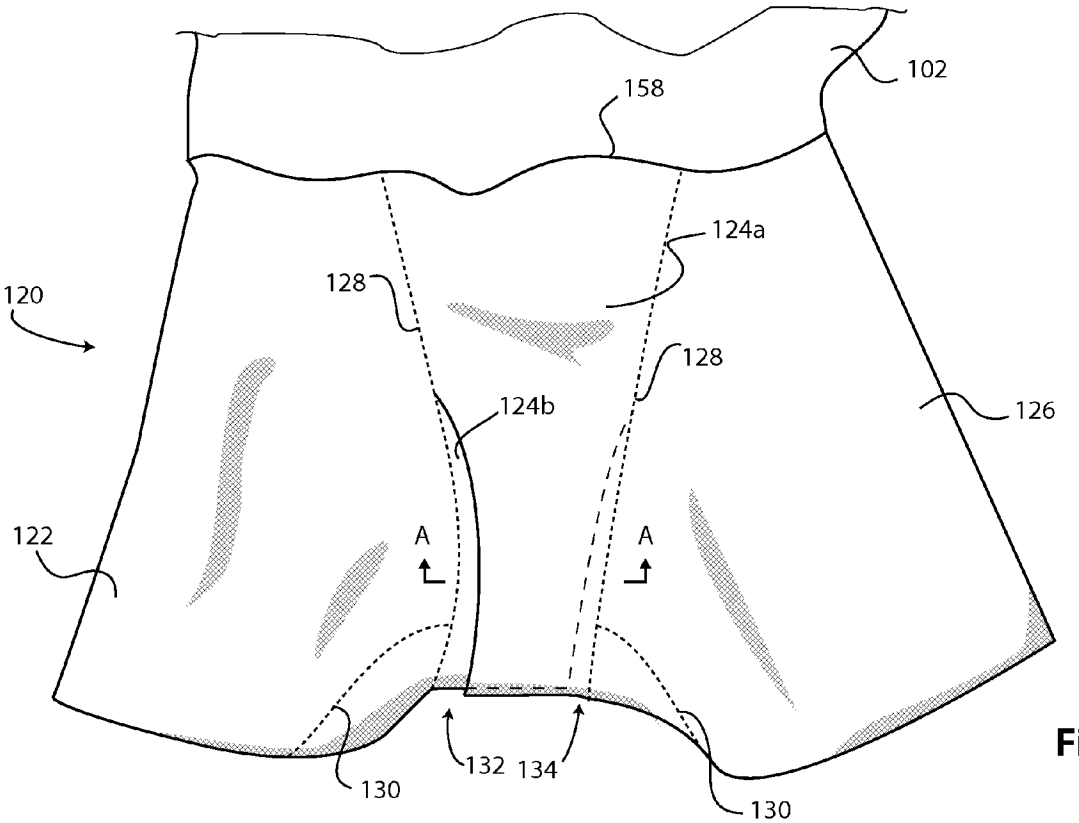
FIG. 2*b* is a view of an exemplary pocketed athletic garment, showing a second embodiment of an inner layer.
Figure 2C:
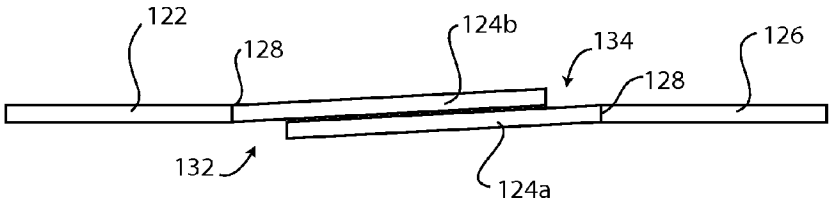
FIG. 2*c* is a cross-sectional view along line A-A of FIG. 2*b*.

FIGS. 2*b*-2*c* shows another exemplary embodiment of inner layer 120, wherein central portion 124 includes a first layer 124*a* and a second layer 124*b*, both layers being substantially coextensive. In the exemplary embodiment, first layer 125*a* may be joined to second side portion 126 along the entire length thereof, and may be joined to first side portion 122 along a portion of the length thereof, defining a first opening 132 between first layer 125*a* and first side portion 122. Similarly, second layer 125*b* may be joined to first side portion 122 along the entire length thereof, and may be joined to second side portion 126 along a portion of the length thereof, defining a second opening 134 between second layer 125*b* and second side portion 126. Openings 132, 134 may be positioned opposite each other and proximate the lower end of center portion 124. The wearer can pull at the edges of openings 132, 134 so as to create a large opening in center portion 124, enabling the wearer to easily relieve themselves when necessary.

The upper edges of outer garment 102 and inner garment 120 may be substantially coterminous with each other and may be coupled to each other by any desired method, for example, conventional stitching. Coupled to the upper edges of outer garment 102 and inner garment 120 may be waistband 150. The lower edge of waistband 150 may be substantially coterminous with the upper edges of garments 102, 120, and may be coupled thereto by any desired method, for example, conventional stitching. Waistband 150 may be coupled to garments 102, 120 by seam 158. Waistband 150 may extend circumferentially around the waist of the wearer. The side edges of waistband 150 may be joined to each other by any desired method, for example, conventional stitching.

Figure 3:
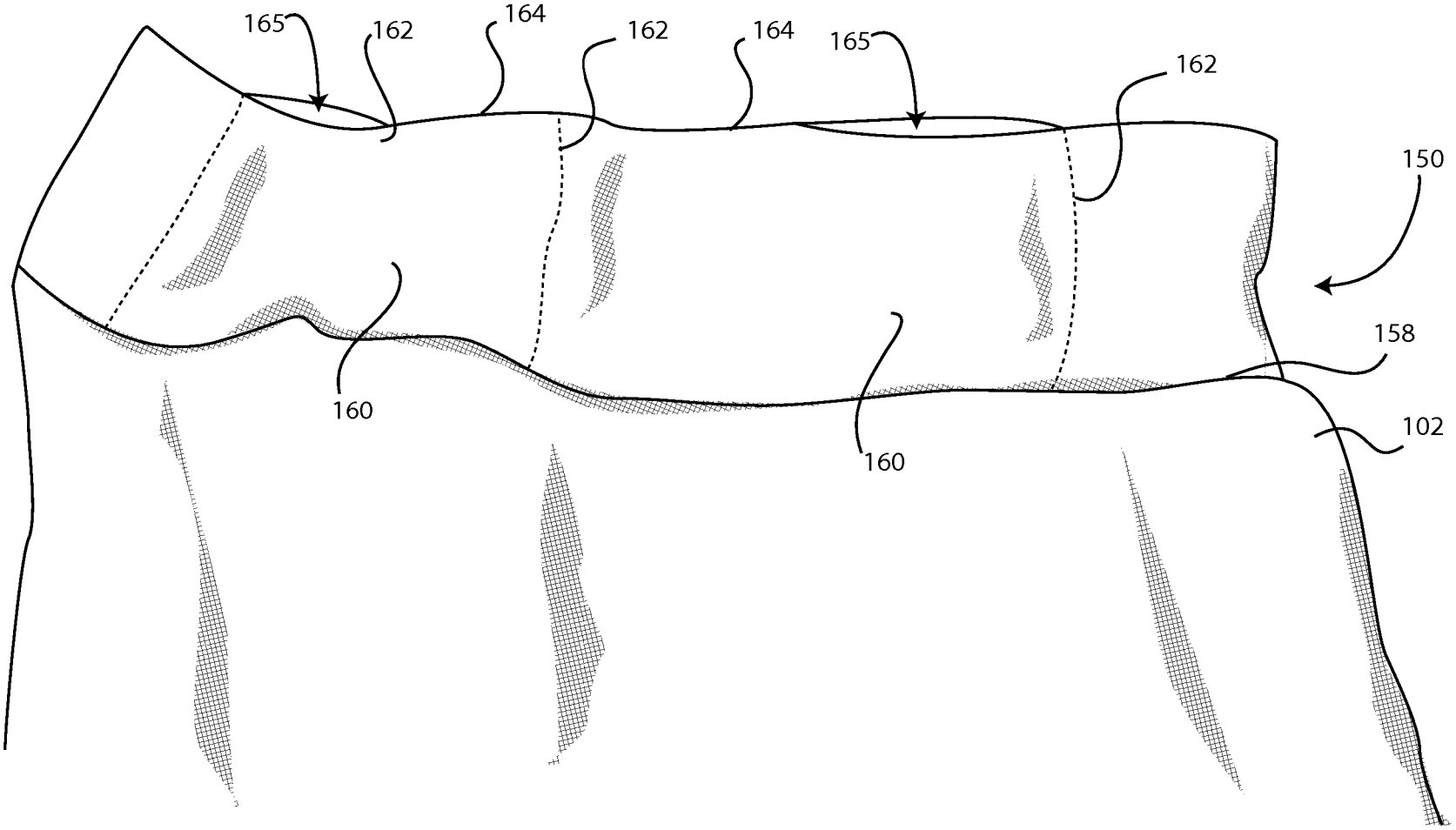
FIG. 3 is an exterior view of the waistband of an exemplary pocketed athletic garment, showing the exterior of a waistband.
Figure 4:
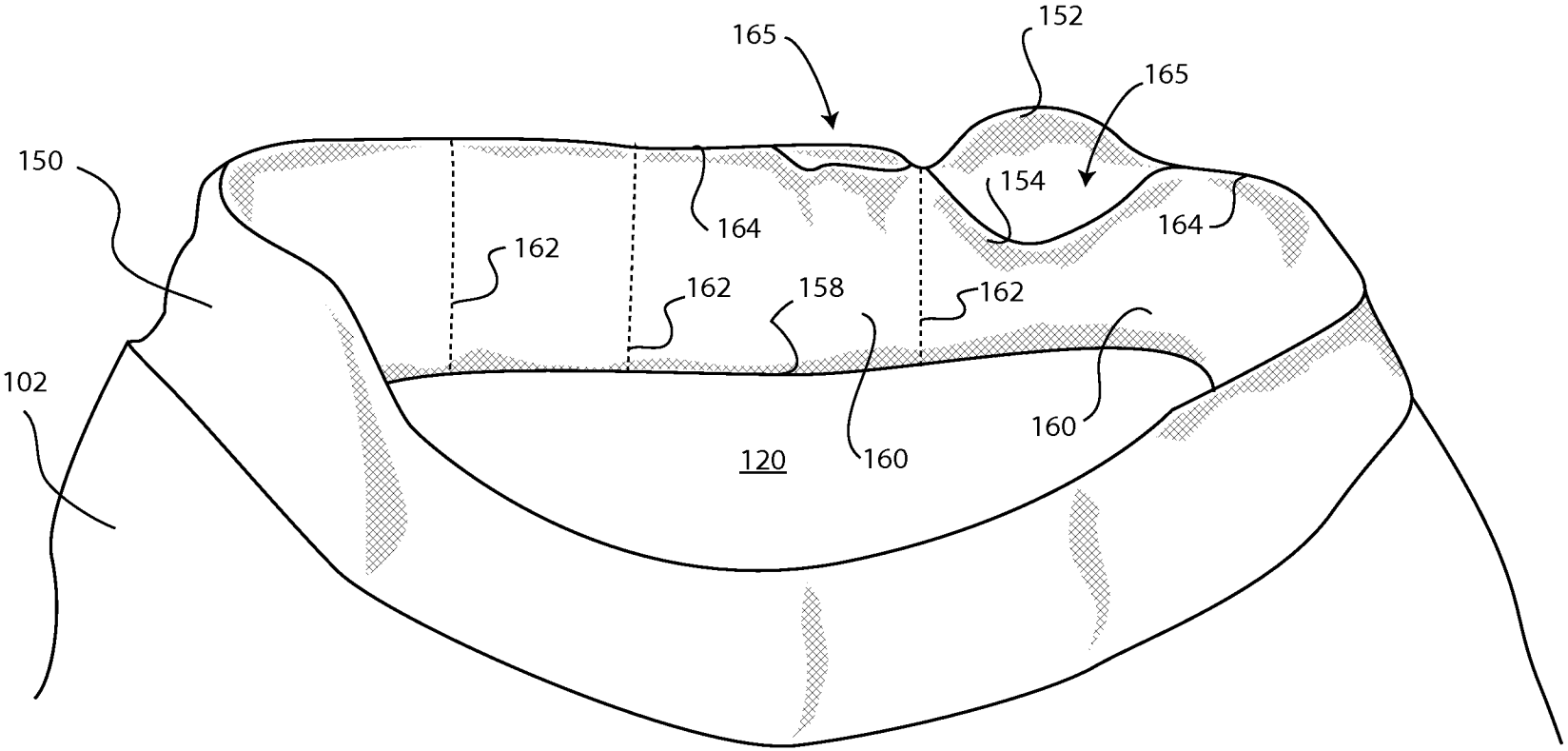
FIG. 4 is an interior view of the waistband of an exemplary pocketed athletic garment, showing the interior of a waistband.

Turning to FIGS. 3-4, waistband 150 may include an outer layer 152 and an inner layer 154. Outer and inner layers 152, 154 may be made from any desired material and have any desired appearance. In some exemplary embodiments, the material of outer layer 152 of waistband 150 may be the material of outer garment 102, while the material of inner layer 154 of waistband 150 may be the material of inner garment 120. Outer and inner layers 152, 154 may be joined at the bottom edges thereof by any desired method, for example, conventional stitching, forming a continuous seam 158. Furthermore, the material from which outer layer 152 and inner layer 154 are formed may be double-layered so as to provide additional thickness and reinforcement to waistband 150.

A plurality of pockets 160 may be defined within waistband 150. Pockets 160 may be disposed between inner layer 154 and outer layer 152 of waistband 150, and may be bounded on the bottom by seam 158. The width of each pocket 160 may be defined by vertical seams 162 which may extend between seam 158 and the upper edge of waistband 150. Vertical seams 162 can join inner layer 152 to outer layer 154 so as to create the side edges of each pocket 160. Additionally, a horizontal seam 164 can be positioned proximate the upper edge of each pocket 160. Horizontal seam 164 can join inner layer 152 to outer layer 154 and can extend over a portion of the width of each pocket 160. Where horizontal seam 164 is not present, an opening 165 may be created. Horizontal seam 164 can serve to limit the width of opening 165, such that the opening 165 has a width less than the width of the pocket 160. This can facilitate maintaining items within the pocket during movement or exercise. Any desired quantity of pockets 160 may be created in this manner around the circumference of waistband 150. Pockets 160 may further have any desired size, and may have varying sizes. In one exemplary embodiment, six pockets may be provided around the circumference of waistband 160.

Turning now to FIGS. 5-8, exemplary patterns which may be used to fabricate a pocketed athletic garment are shown. Exemplary measurements for the components of the pocketed garment are provided based on a wearer having a waistline of about 26.5 in., and a hipline of about 38 in.; however, adjustments to these measurements may be made according to known methods as desired, based on the specific measurements of the wearer.

Figure 5:
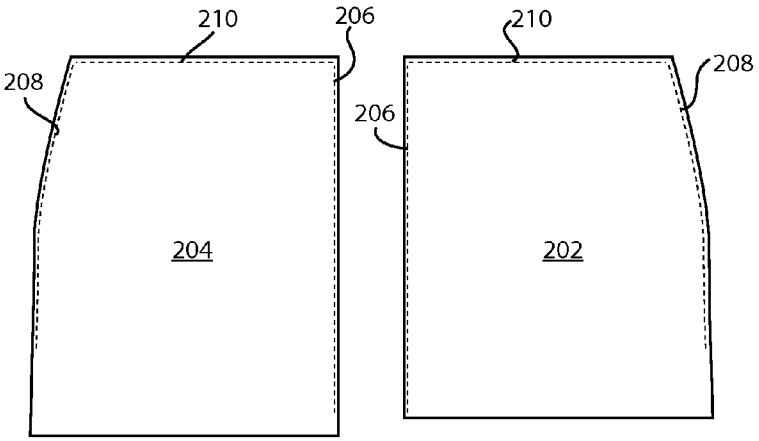
FIG. 5 shows exemplary patterns for the outer layer of an exemplary pocketed athletic garment.

FIG. 5 shows an exemplary front portion pattern 202 and rear portion pattern 204 which can be used to form the outer layer 102 of the pocketed garment. In the exemplary method, the front portion may be cut from fabric, for example a nylon-spandex blend. The front portion may be cut so as to have a length of about 12 inches, a width of about 18 inches at the top edge, and a width of about 21.5 inches at the bottom edge. The rear portion may be cut similarly, except with an additional length of about 0.375 in. The front and rear portions 202, 204 may be coupled together at the first side edges 206 and second side edges 208 thereof. At the second side edges, a portion of second side edges 208 may be left unfastened to each other, creating a split about 4 in. extending from the bottom edge of outer layer 102. Additionally the bottom edge of the outer layer 102 may then be hemmed, for example with an about 0.625 inch hem, and the edges of the splits may be hemmed, for example with an about 0.25 inch hem. The top edges 210 of front and rear portions 202, 204 may be coupled to the lower edge of waistband 150.

Figure 6:
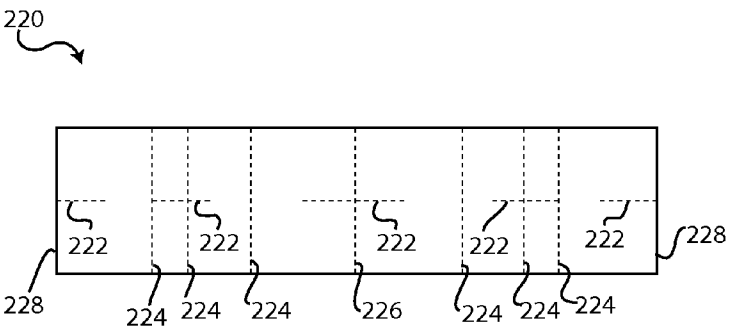
FIG. 6 shows an exemplary pattern for the waistband of an exemplary pocketed athletic garment.

FIG. 6 shows an exemplary waistband pattern 220 for both the outer layer 152 and inner layer 154 of waistband 150. Two waistband pieces may be formed according to pattern 220, one piece from the material of the outer layer of the pocketed garment, and the other piece from the material of the inner layer of the pocketed garment. These two waistband pieces may form the outer layer 152 and inner layer 154 of the waistband 150, respectively. Exemplary measurements for the waistband may be a height of about 6 in. and a length of about 24 in.; however, the length of the waistband may be adjusted by adding about 0.5 in. of length for an increase of about 1 in. in the waistline of the wearer.

To form waistband 150, the inner layer piece and the outer layer piece may be positioned so as to be coextensive with each other. Subsequently, the inner and outer layer pieces may be joined to each other along the horizontal centerlines 222, thereby forming horizontal seams 164 and defining openings 165 of the pockets. The inner layer piece may then be folded in half along horizontal lines 122. The two layers of the inner layer piece can then be joined to the outer layer piece along vertical lines 224, thereby forming vertical seams 162 and defining the widths of the pockets. Subsequently, the outer layer piece may be folded in half and the two layers of the inner layer piece can be joined to the two layers of the outer layer piece along vertical centerline 226, thereby forming another vertical seam 162. Finally, the vertical edges 228 of the inner and outer layer pieces can be sewn to each other, forming the waistband 150. For the vertical lines 224, exemplary distances from the vertical centerline 226 of the pattern 220 may include about 4 in., about 7.5 in., about 9.25 in, and about 12.75 in.; however, any desired distances may be used depending on the desired size and number of pockets.

Figure 7:
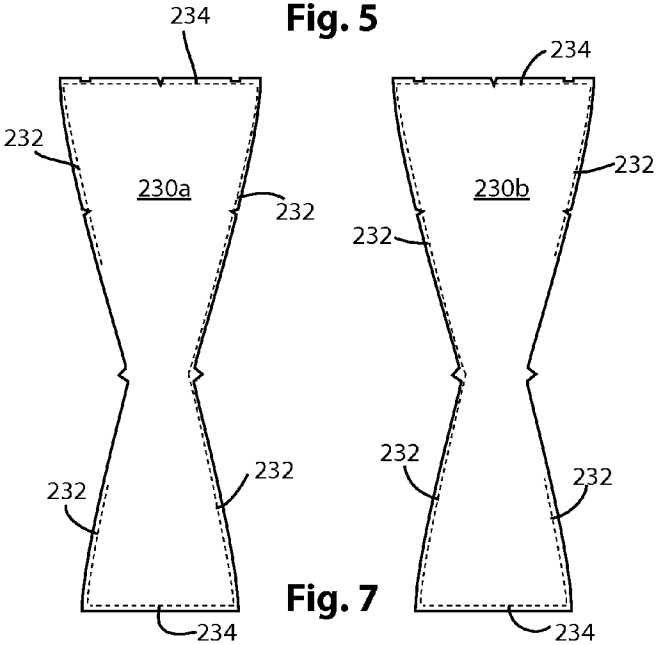
FIG. 7 shows an exemplary pattern for the central portion of the inner layer of an exemplary pocketed athletic garment.

FIG. 7 shows exemplary patterns 230 for the central portion 124 of the inner layer 120 of the pocketed garment. The pattern 230*a* can be used for the first layer 125*a* of the central portion, while the pattern 230*b* can be used for the second layer 125*b* of the central portion. The central portion piece can be joined to the leg pieces along its side edges 232. Gaps in the stitching on side edges 232 are shown to indicate where openings 132/134 may be positioned. In other exemplary embodiments, a single pattern 230 may be used for a single-layered central portion, with the central portion piece being joined to the leg pieces along its side edges 232 without gaps for the openings. The horizontal edges 234 of the central portions 230 can be joined to the bottom edge of waistband 150.

Figure 8:
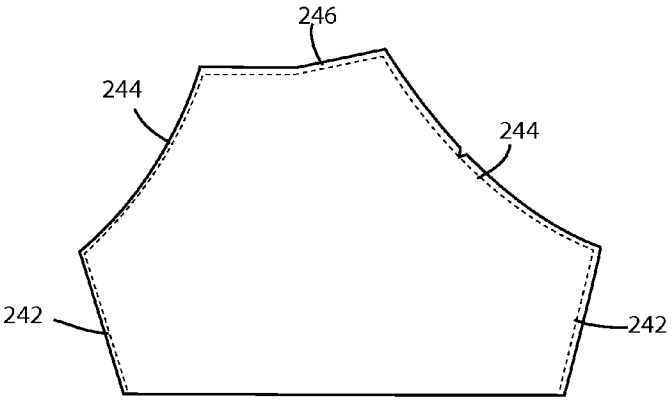
FIG. 8 shows an exemplary pattern for the first and second side portions of the inner layer of an exemplary pocketed athletic garment.

FIG. 8 shows an exemplary pattern 240 for the first and second side portions 122, 126 of the inner layer 120 of the pocketed garment. The side portion piece can be joined to itself along lower side edges 242 so as to form a tubular enclosure for the upper portion of a wearer's leg. The side portion piece can also be joined to the central piece along upper side edges 244, except in the location of the openings therebetween. The upper edge 246 of the side portion piece can be joined to the bottom edge of waistband 150.

Subsequently, the outer layer, inner layer, and waistband may be coupled to each other by turning the outer and inner layers inside out, placing the waistband inside the outer layer, and placing the inner layer inside the waistband, such that the raw edges of all three elements are substantially even. All three elements may then be stitched together, while stretching the waistband so that the diameter of the waistband matches the diameter of the outer and inner layers. This can result in a gathering effect of the outer layer. Subsequently, the garment may be turned right side out.

It should be appreciated that the above described patterns and method of forming the pocketed garment should not be construed as limiting, and that the pocketed garment described herein may be fabricated in any desired way and from any number of portions. The pocketed garment described herein can thus provide a comfortable, versatile garment for athletic exercise, allowing the wearer to have a garment that has a desired outer appearance, a comfortable inner layer that reduces the likelihood of discomfort during exercise, an easily accessible way to relieve themselves without having to remove the garment, and a waistband which includes pockets that can securely carry items while reducing the likelihood of the items bouncing during exercise or falling out of the pockets during exercise.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A pocketed athletic garment, comprising:

an outer layer wherein the outer layer is a skirt;

an inner layer wherein the inner layer is a compression garment; and a waistband adapted to extend around the waist of a wearer when the garment is worn and permanently affixed to the outer layer and the inner layer, the waistband including a plurality of pockets having a top edge proximate an upper edge of the waistband and a bottom edge disposed between an outer waistband layer and an inner waistband layer and separated by vertical seams extending from the bottom edge to the top edge of the plurality of pockets wherein each pocket includes an opening having a width that is less than a width of the pocket wherein the outer waistband layer is coextensive with the inner waistband layer.

2. The garment of claim 1, wherein the inner layer includes a first leg portion, a second leg portion, and a central portion coupled to the first leg portion and the second leg portion.

3. The garment of claim 2, wherein the central portion includes a first layer and a second layer.

4. The garment of claim 3, further comprising:

a first opening disposed between the first layer and the first leg portion; and a second opening disposed between the second layer and the second leg portion.

5. The garment of claim 4, wherein the first opening is positioned opposite the second opening.

6. The garment of claim 1, wherein the outer layer is formed from a spandex blend.

7. The garment of claim 1, wherein the inner layer is formed from an elastic material.

* * * * *